US011220387B2

(12) United States Patent
Gustvasson

(10) Patent No.: US 11,220,387 B2
(45) Date of Patent: Jan. 11, 2022

(54) SEALED SINGLE-DOSE BREAK-OPEN PACKAGE AND RELATIVE PRODUCTION METHOD

(71) Applicant: V-SHAPES S.R.L., Calderara di Reno (IT)

(72) Inventor: Erland Jesper Gustvasson, Arezzo (IT)

(73) Assignee: V-SHAPES S.R.L., Calderara di Reno (IT)

( * ) Notice: Subject to any disclaimer, the term of this patent is extended or adjusted under 35 U.S.C. 154(b) by 0 days.

(21) Appl. No.: 16/959,416

(22) PCT Filed: Dec. 18, 2018

(86) PCT No.: PCT/IT2018/000166

§ 371 (c)(1),
(2) Date: Jun. 30, 2020

(87) PCT Pub. No.: WO2019/138435

PCT Pub. Date: Jul. 18, 2019

(65) Prior Publication Data

US 2021/0070518 A1 Mar. 11, 2021

(30) Foreign Application Priority Data

Jan. 9, 2018 (IT) ..... 102017000149752
Jan. 9, 2018 (IT) ..... 102017000149766

(51) Int. Cl.
*B65D 75/58* (2006.01)
*B65D 75/30* (2006.01)

(52) U.S. Cl.
CPC ..... *B65D 75/585* (2013.01); *B65D 75/5855* (2013.01); *B65D 75/30* (2013.01); *B65D 2221/00* (2013.01)

(58) Field of Classification Search
CPC ..... B65D 75/30; B65D 75/58; B65D 75/585; B65D 75/5855; B65D 2221/00; B65D 77/20; B65D 77/2024
(Continued)

(56) References Cited

U.S. PATENT DOCUMENTS 8,069,985 B2 * 12/2011 Burattini ..... B65D 75/585 206/469
8,225,932 B2 * 7/2012 Burattini ..... B31B 70/25 206/469
(Continued)

FOREIGN PATENT DOCUMENTS

CN 85107387 A 6/1986
CN 1079705 A 12/1993
(Continued)

OTHER PUBLICATIONS

International Search Report dated Feb. 27, 2019 from counterpart PCT App No. PCT/IT2018/000166.
(Continued)

*Primary Examiner* — Bryon P Gehman
(74) *Attorney, Agent, or Firm* — Shuttleworth & Ingersoll, PLC; Timothy Klima

(57) ABSTRACT

A sealed single-dose break-open package having: a first sheet of semi-rigid plastic material; a second sheet of flexible plastic material superposed on and sealed to the first sheet to define a sealed pocket that contains a dose of a product; and a weakened zone that is made in a central zone of the first sheet for guiding, after bending of the sealed package, controlled breaking of the first sheet at the weakened zone in such a way as to cause the formation of an outlet opening for the product through the first sheet. The weakened zone comprises at least one incision that is made in a surface of the first sheet and extends along a single line that is open and does not cross itself. The incision comprises
(Continued)

a "U"-shaped central part and two lateral parts that are positioned on opposite sides of the central part and connect to the central part.

18 Claims, 10 Drawing Sheets

(58) Field of Classification Search
USPC ..... 206/469, 484
See application file for complete search history.

(56) References Cited

U.S. PATENT DOCUMENTS

| | | | | |
|---|---|---|---|---|
| 10,131,479 | B2 * | 11/2018 | Burattini | B65D 75/30 |
| 10,214,337 | B2 * | 2/2019 | Huffer | B65D 33/20 |
| 10,661,962 | B2 * | 5/2020 | Hashimoto | B65D 77/2024 |
| 2003/0089625 | A1 | 5/2003 | Moodie | |
| 2014/0231296 | A1 * | 8/2014 | Reggio | B65D 75/30 206/484 |

FOREIGN PATENT DOCUMENTS

| | | | |
|---|---|---|---|
| CN | 101568477 | A | 10/2009 |
| CN | 107117390 | A | 9/2017 |
| JP | 3185755 | U | 9/2013 |
| WO | 0144071 | A1 | 6/2001 |
| WO | 2008038074 | A2 | 4/2008 |
| WO | 2009040629 | A2 | 4/2009 |
| WO | 2013054169 | A1 | 4/2013 |

OTHER PUBLICATIONS

Chinese Office Action dated Jul. 23, 2021 from counterpart Chinese Patent Application No. 201880086052.1.

* cited by examiner

SEALED SINGLE-DOSE BREAK-OPEN PACKAGE AND RELATIVE PRODUCTION METHOD

This application is the National Phase of International Application PCT/IT2018/000166 filed Dec. 18, 2018 which designated the U.S.

This application claims priority to Italian Patent Application No. 102017000149752 filed Jan. 9, 2018, and Italian Patent Application No. 102017000149766 filed Jan. 9, 2018. Both applications are incorporated by reference herein.

TECHNICAL FIELD

The present invention relates to a sealed single-dose break-open package and to a relative production method.

BACKGROUND ART

The patent application WO2008038074A2 describes a sealed single-dose break-open package; the sealed package comprises a sheet of semi-rigid plastic material and a sheet of flexible plastic material which is superposed on and sealed to the sheet of semi-rigid plastic material to form a sealed pocket that contains a dose of a fluid product. The sheet of semi-rigid plastic material has in the central part a weakened zone for guiding controlled breakage of the sheet of semi-rigid plastic material in such a way as to cause the formation of an outlet opening for the product through the sheet of semi-rigid plastic material itself. In other words, to open the sealed package a user must grab the sealed package itself with the fingers of one hand and "V"-bend the sealed package until the sheet of semi-rigid plastic material breaks at the weakened zone. The weakened zone comprises an inner incision that is made through an inner surface (that is, facing the pocket) of the sheet of semi-rigid plastic material and an outer incision that is made through an outer surface of the sheet of semi-rigid plastic material and aligned with the inner incision.

In patent application WO2008038074A2, the incisions vary in depth in order to break the sheet of semi-rigid plastic material progressively during the "V"-bending of the sealed package. However, making incisions that vary in depth is relatively complicated since it requires a very high precision of movement of the blades of the incision unit; amongst others, the precision of movement of the blades of the incision unit tends to decrease with the increase of the operating speed and as a result, to obtain a very high precision of movement of the blades of the incision unit it is not possible to reach particularly high operating speeds.

Moreover, the sealed single-dose package described in patent application WO2008038074A2 does not allow to apply (spread) the product contained inside the package itself in a precise and intuitive manner on a surface and therefore that package is not suitable to contain spreadable products (that is, to be spread on a surface).

DISCLOSURE OF THE INVENTION

The object of the present invention is to provide a sealed single-dose break-open package and a relative production method that are free from the above mentioned disadvantages.

According to the present invention, a sealed single-dose break-open package and a relative production method are provided in accordance with the accompanying claims.

BRIEF DESCRIPTION OF THE DRAWINGS

The invention will be now described with reference to the accompanying drawings that show some non-limiting embodiments of the invention itself, wherein.

DETAILED DESCRIPTION OF PREFERRED EMBODIMENT OF THE INVENTION

Figure 1:
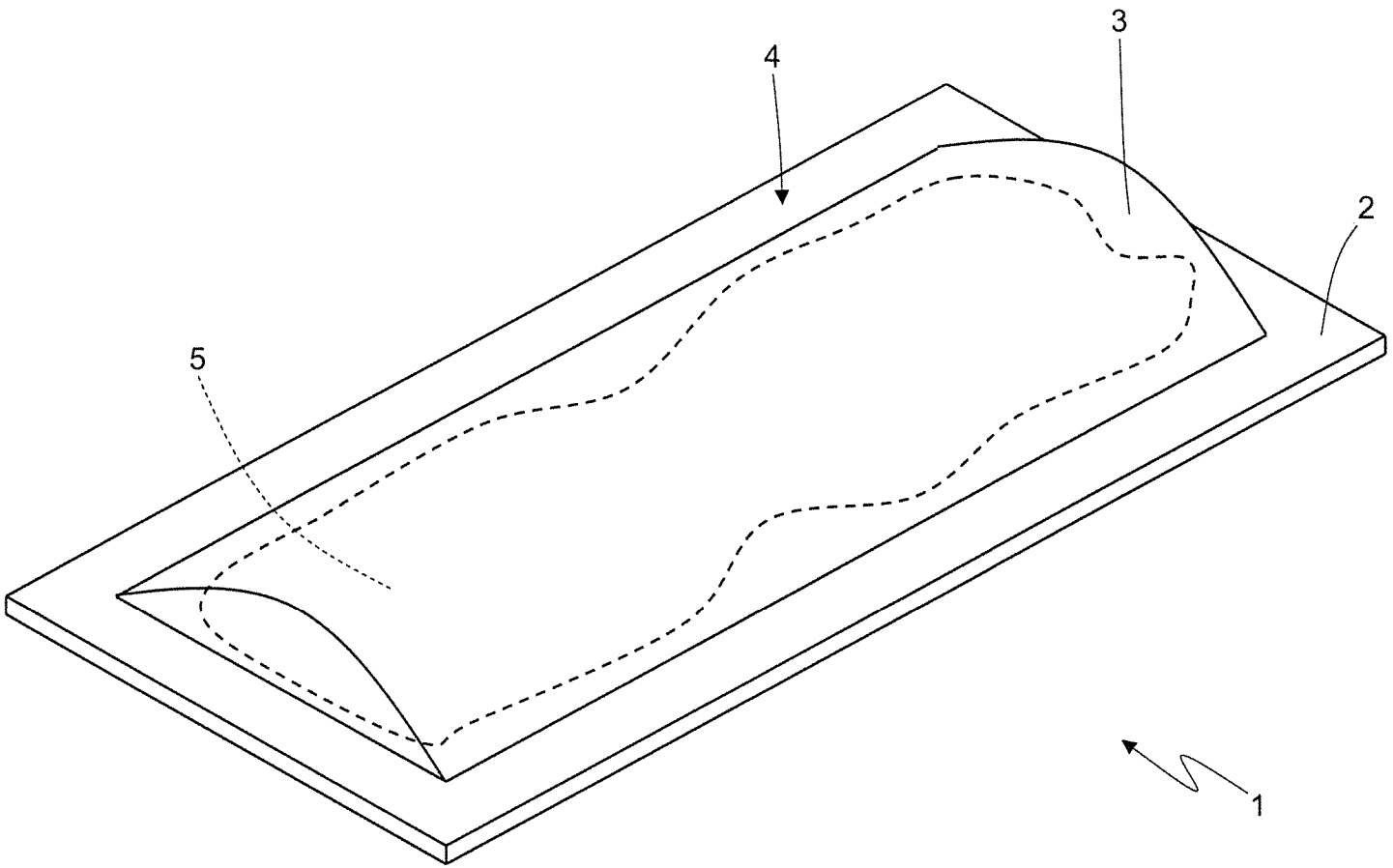
FIG. 1 illustrates a topside view in perspective of a sealed single-dose break-open package produced in accordance with the present invention and in a flat configuration.
Figure 2:
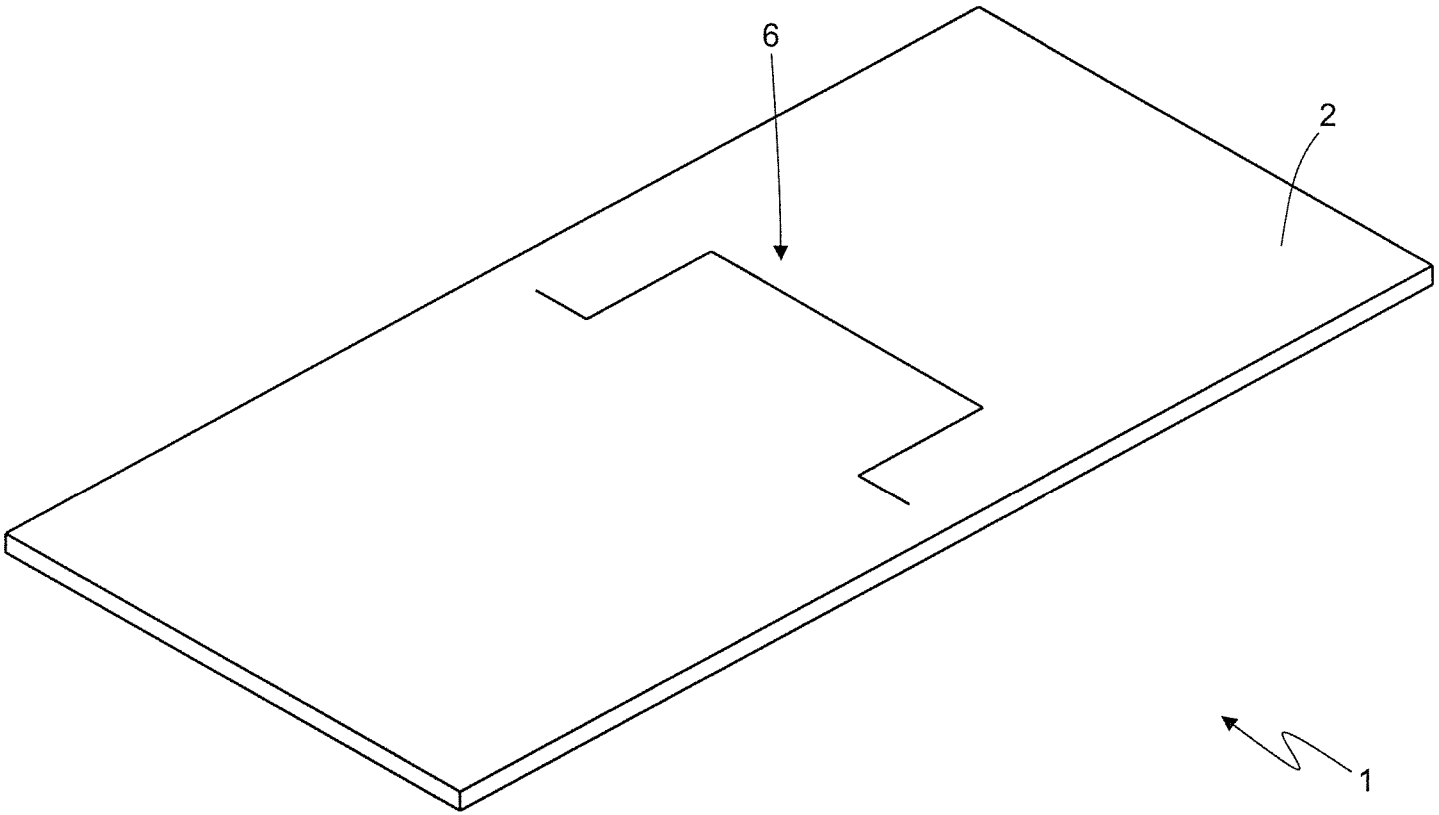
FIG. 2 illustrates an underside view in perspective of the sealed package of FIG. 1 in a flat configuration.

Number 1 in FIGS. 1 and 2 indicates as a whole a sealed single-dose break-open package. The sealed single-dose package 1 comprises a rectangular sheet 2 of semi-rigid plastic material and a rectangular sheet 3 of flexible plastic material superposed on and sealed to sheet 2 of semi-rigid plastic material to form (between sheets 2 and 3) a sealed pocket 4 containing a dose of a fluid product 5.

Figure 3:
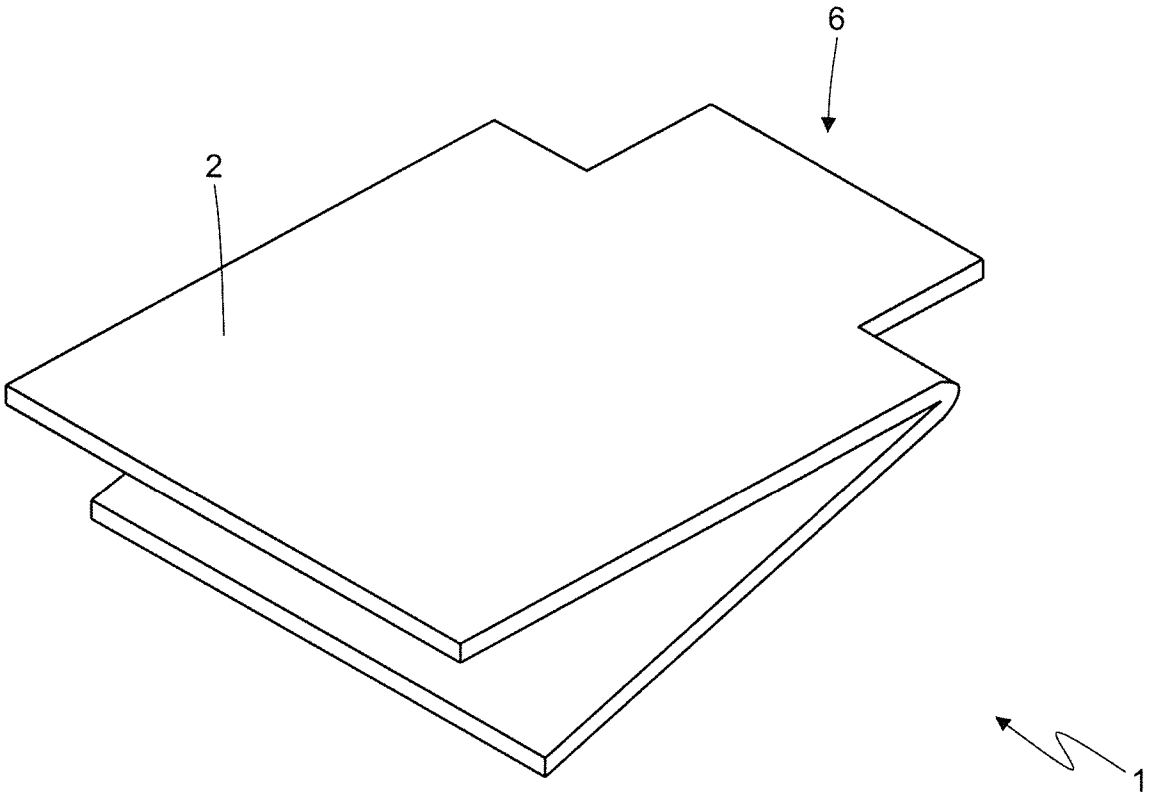
FIG. 3 is a bottom-up view in perspective of the sealed package of FIG. 1 in a "V"-shaped configuration.

The sheet 2 of semi-rigid plastic material has a weakened zone 6 in the central part for guiding controlled breakage of the sheet 2 of semi-rigid plastic material in such a way as to cause the formation of an outlet opening for the product 5 through the sheet 2 of semi-rigid plastic material. In other words, to open the sealed single-dose package 1, a user has to grip the sealed single-dose package 1 with the fingers of one hand and "V"-bend (as shown in FIG. 3) the sealed single-dose package 1 until the sheet 2 of semi-rigid plastic material breaks at the weakened zone 6. By breaking the sheet 2 of semi-rigid plastic material at the weakened zone 6, the product 5 can flow smoothly and hygienically out of the sealed single-dose package 1.

Figure 4:
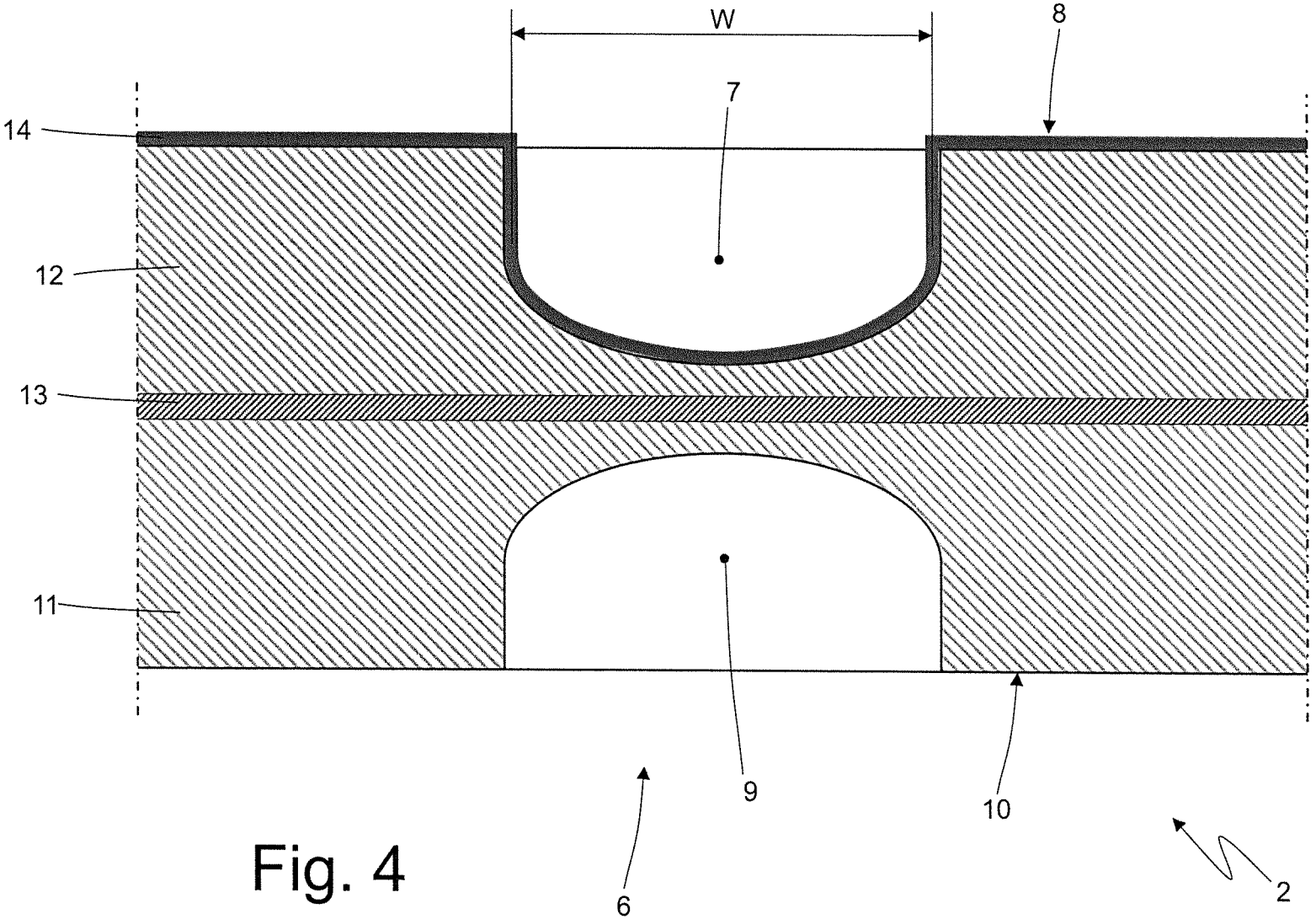
FIG. 4 is a schematic view in cross-section and at a weakened zone of a semi-rigid sheet of the sealed package of FIG. 1.

According to FIG. 4, the weakened zone 6 comprises one inner incision 7 (not passing through, i.e. it does not go completely through the sheet 2 of semi-rigid plastic material) which is made through an inner surface 8 (that is, oriented towards pocket 4 or facing pocket 4) of the sheet 2 of semi-rigid plastic material and a outer incision 9 (not passing through, i.e. it does not go completely through the sheet 2 of semi-rigid plastic material) that is made through an outer surface 10 (that is, opposite to pocket 4) of the sheet 2 of semi-rigid plastic material. The two incisions 7 and 9 are identical (that is, shape and dimensions of the inner incision 7 are equal to the shape and dimensions of the outer incision 9), aligned and superposed (that is, the two incisions 7 and 9 are placed exactly in the same position on the opposite surfaces 8 and 10 of the sheet 2 of semi-rigid plastic material). The two incisions 7 and 9 do not touch, that is, a residual portion of the sheet 2 of semi-rigid plastic material interposes itself between the two incisions 7 and 9, to preserve the integrity of sealed pocket 4. Moreover, the sheet 2 of semi-rigid plastic material and the sheet 3 of flexible plastic material in this example of embodiment are made in such a way that incisions 7 and 9 determine the required breakage of the sheet 2 of semi-rigid plastic material when exposed to the forces generated by the "V"-bending (shown in FIG. 3).

According to the example of embodiment illustrated in FIG. 3, the sheet 2 of semi-rigid plastic material is a laminate and includes an outer supporting layer 11 (that is, on the side opposite to pocket 4 in the area of the outer surface 10) and an inner supporting layer 12 (that is, on the side of pocket 4 in the area of the inner surface 8). An insulating or barrier layer 13 is provided between the two supporting layer 11 and 12 to ensure impermeability to air and/or light; in other words, the barrier layer 13 is enclosed by the two supporting layers 11 and 12 and separates the supporting layers 11 and 12 itself from one another. The supporting layer 12 is covered by a heat-sealable layer 14 which is placed internally (that is, on the same side of pocket 4 and in contact with sheet 3 of flexible plastic material to allow the heat-sealing to the sheet 3 of flexible plastic material itself).

According to some embodiments shown in the attached figures, the two supporting layers 11 and 12 may have the same thickness (i.e. are specular or twins); however, according to other embodiments, the two supporting layers 11 and 12 may have different thicknesses, i.e. the thickness of supporting layer 11 is different from thickness of supporting layer 12.

As non-limiting example, the sheet 2 of semi-rigid plastic material may be composed of: a supporting layer 11 of white polystyrene (PS) with a thickness of 200 micron (±10%), a barrier layer 13 of "Evoh" or dialuminium with a thickness of 10 micron (±10%), a supporting layer 12 of white polystyrene (PS) with a thickness of 200 micron (±10%), and a heat-sealable layer 14 of polyethylene (PE) with a thickness of 50 micron (±10%). Alternatively, supporting layers 11 and 12 may be composed of polylactic acid (PLA) preferably biaxially oriented, and/or the heat-sealable layer 14 may be composed of polypropylene (PP). Polylactic acid (PLA) is generally heat-sealable, therefore when supporting layers 11 and 12 are made of polylactic acid (PLA), heat-sealable layer 14 may be absent since the sheet 3 of flexible plastic material may be heat-sealed directly to supporting layer 12 of polylactic acid (PLA). Moreover, when supporting layers 11 and 12 are made of polylactic acid (PLA) or polypropylene (PP), it is possible to reduce the thickness of the supporting layers 11 and 12 itself since polylactic acid (PLA) and polypropylene (PP) allow to obtain sufficiently rigid supporting layers 11 and 12 even with a small thickness. As example, if supporting layers 11 and 12 are made of polystyrene (PS), the overall thickness of supporting layers 11 and 12 has to be higher than 350-380 micron, while if supporting layers 11 and 12 are made of polylactic acid (PLA) or polypropylene (PP) the overall thickness of supporting layers 11 and 12 may reach even 200 micron.

Each incision 7 or 9 has on the surface (i.e. at the surface of the corresponding supporting layer 11 or 12) a width W that may vary according to the plastic material used to make the supporting layers 11 and 12: with white polystyrene (PS) the width W of each incision 7 or 9 may range between 0.5 e 1.5 mm while with biaxially oriented polylactic acid (PLA) or with polypropylene (PP) the width W of each incision 7 or 9 may range between 2 and 4 mm. As a result, the width W of each incision 7 or 9 when using biaxially oriented polylactic acid (PLA) or polypropylene (PP) is higher than the width W of each incision 7 or 9 when using polystyrene (PS). These differences are due to the fact that biaxially oriented polylactic acid (PLA) and polypropylene (PP) become fragile (i.e. easily breakable) when crushed (deformed by compression) as occurs by making incisions 7 and 9 and as a result, it is more convenient to have relatively wide incisions 7 and 9 to obtain in supporting layers 11 and 12 residual parts (i.e. what remains of supporting layers 11 and 12 in the area of incision 7 and 9) with a high fragility that helps the breakage of package 1 when it is "V"-bended (as shown in FIG. 3). According to another embodiment not shown, in the sheet 2 of semi-rigid plastic material, supporting layer 12 is absent (i.e. the barrier layer 13 is directly in contact with heat-sealable layer 14) and supporting layer 11 has a double thickness (i.e. supporting layer 12 is "embedded" in supporting layer 11).

The outer incision 9 is made through the outer surface 10 of the sheet 2 of semi-rigid plastic material and can be made by deforming locally the sheet 2 of semi-rigid plastic material and in particular the supporting layer 11 of the sheet 2 of semi-rigid plastic material; the outer incision 9 ends before the barrier layer 13 and therefore it does not affect the barrier layer 13 itself.

The inner incision 7 is made in the inner surface 8 of the sheet 2 of semi-rigid plastic material and can be executed by deforming locally the sheet 2 of semi-rigid plastic material and in particular the supporting layer 12 of the sheet 2 of semi-rigid plastic material; the inner incision 7 ends before the barrier layer 13 and therefore it does not affect the barrier layer 13 itself.

In the area of the inner incision 7 the heat-sealable layer 14 can be deformed or torn (partially or completely); in any case, at the inner incision 7 there is no sealing of any kind between the sheet 2 of semi-rigid plastic material and the sheet 3 of flexible plastic material and therefore the possible local damage of the heat-sealable layer 14 does not have any consequence.

In some embodiments, the barrier layer 13 may be located between the two supporting layers 11 and 12 to build a barrier for the product inside the sealed pocket 4. In some embodiments, the incisions 7 and 9 may not affect the barrier layer 13. In some embodiments, the barrier layer 13 may be thick and solid enough to allow a partial penetration of incisions 7 and 9 provided that the barrier layer 13 is designed to maintain its barrier function. In some embodiments, the integrity of barrier layer 13 of the sheet 2 of semi-rigid plastic material secures the barrier function and therefore the tightness for the content of the sealed pocket 4 even in the area of the incisions 7 and 9 and therefore the sealed pocket 4 is suitable to contain also perishable products and/or with controlled bacterial load like food, medicines or cosmetics. During the opening by breakage of the sealed single-dose package 1 by "V"-bending the sealed single-dose package 1 (as shown in FIG. 3), it is necessary to break at the weakened area 6 all the supporting layers 11 and 12, barrier layer 13 and heat-sealable layer 14 of the sheet 2 of semi-rigid plastic material.

In some embodiments, inner incision 7 and outer incision 9 may have an essentially constant depth lengthwise (net of the inevitable construction tolerances).

Figure 5:
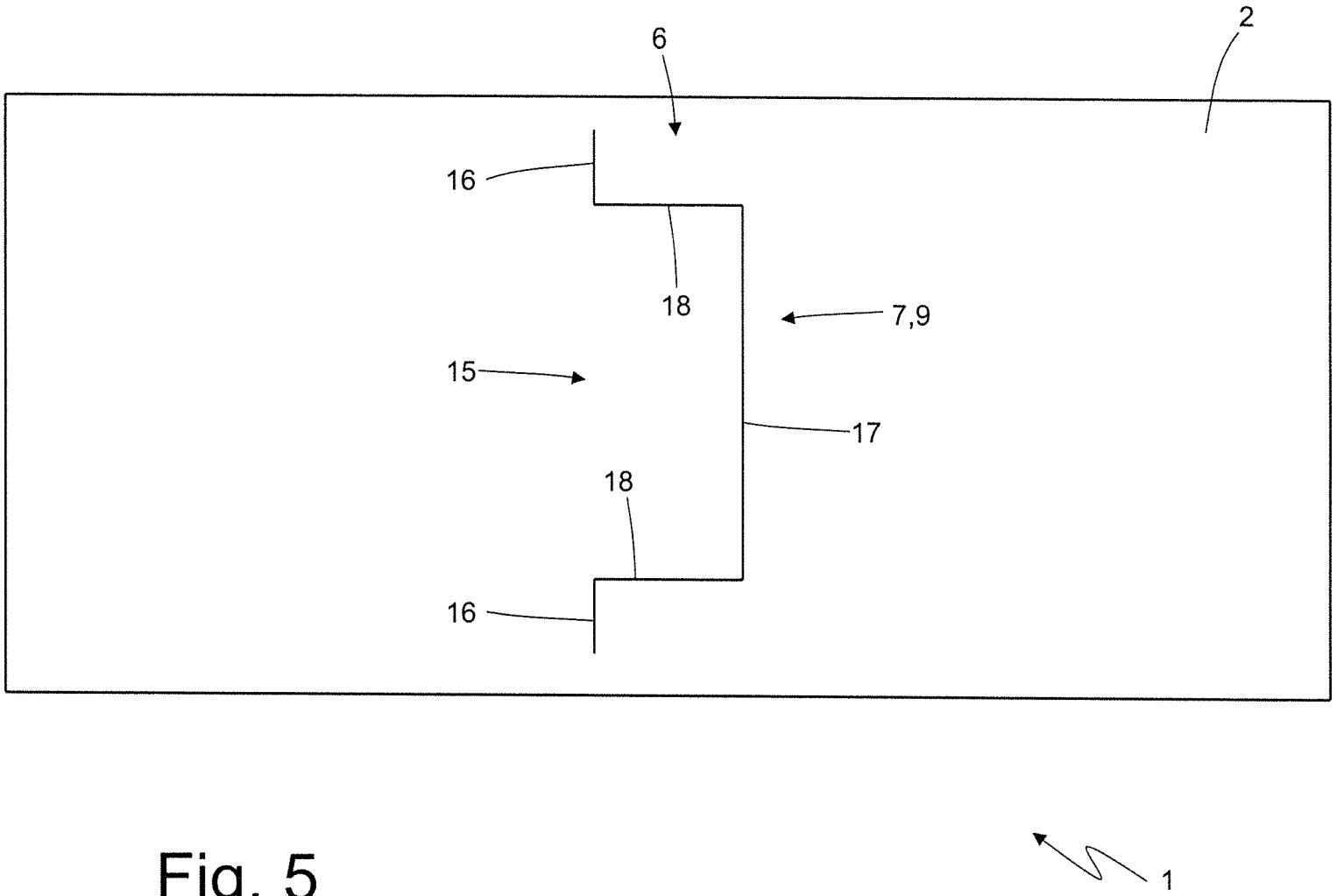
FIG. 5 is a bottom-up view of the package of FIG. 1.

As shown in FIG. 5, each incision 7 and 9 (the two incisions 7 and 9 are identical to and superposed on each other and therefore not distinguishable in FIG. 5) develops along a single line with broken shape (i.e. a single zig-zag line), that is a line composed of an ordered set of consecutive oriented segments (i.e. such that the second end of a segment matches with the first end of the following segment) and not adjacent (i.e. such that a segment and the following segment do not belong to the same straight line). Moreover, each incision 7 and 9 develops along a single line with broken shape (i.e. a single zig-zag line) that is open (i.e. the first end and the last end do not match) and not intertwined (i.e. the sides of the line have no intersection point). According to some embodiments, the segments of the single line with broken shape (i.e. a zig-zag single line) along which incisions 7 and 9 develop are essentially parallel or essentially perpendicular and therefore a segment forms always an essentially right angle with the next segment.

Each incision 7 and 9 has a "U"-shaped central part 15 and two lateral parts 16 that are placed on the opposite sides of the central part 15 and connected to the central part 15 itself. The two lateral parts 16 are constituted of two respective straight line segments that have identical dimension and are aligned with each other (i.e. one lies on the extension of the other). The central part is constituted of a main segment 17 that is essentially parallel to and offset from (i.e. not aligned) the two lateral parts 16 and of two joining segments 18 that are essentially parallel to and offset from each other (i.e. not aligned), are essentially perpendicular to the main segment 17 and are essentially perpendicular to the two lateral parts 16; each joining segment 18 connects a lateral part 16 to one end of the main segment 17.

On the whole, each incision 7 and 9 has a square "Ω" shape (i.e. constituted only of segments essentially parallel or essentially perpendicular to each other).

As better shown in the attached figures, the weakened zone 6 does not affect the whole width of the sheet 2 of semi-rigid plastic material, but affects only a central portion of the sheet 2 of semi-rigid plastic material leaving intact (i.e. without the weakened zone 6) two lateral portions of the sheet 2 of semi-rigid plastic material symmetrically placed on opposite sides of the weakened zone 6 itself.

Figure 6:
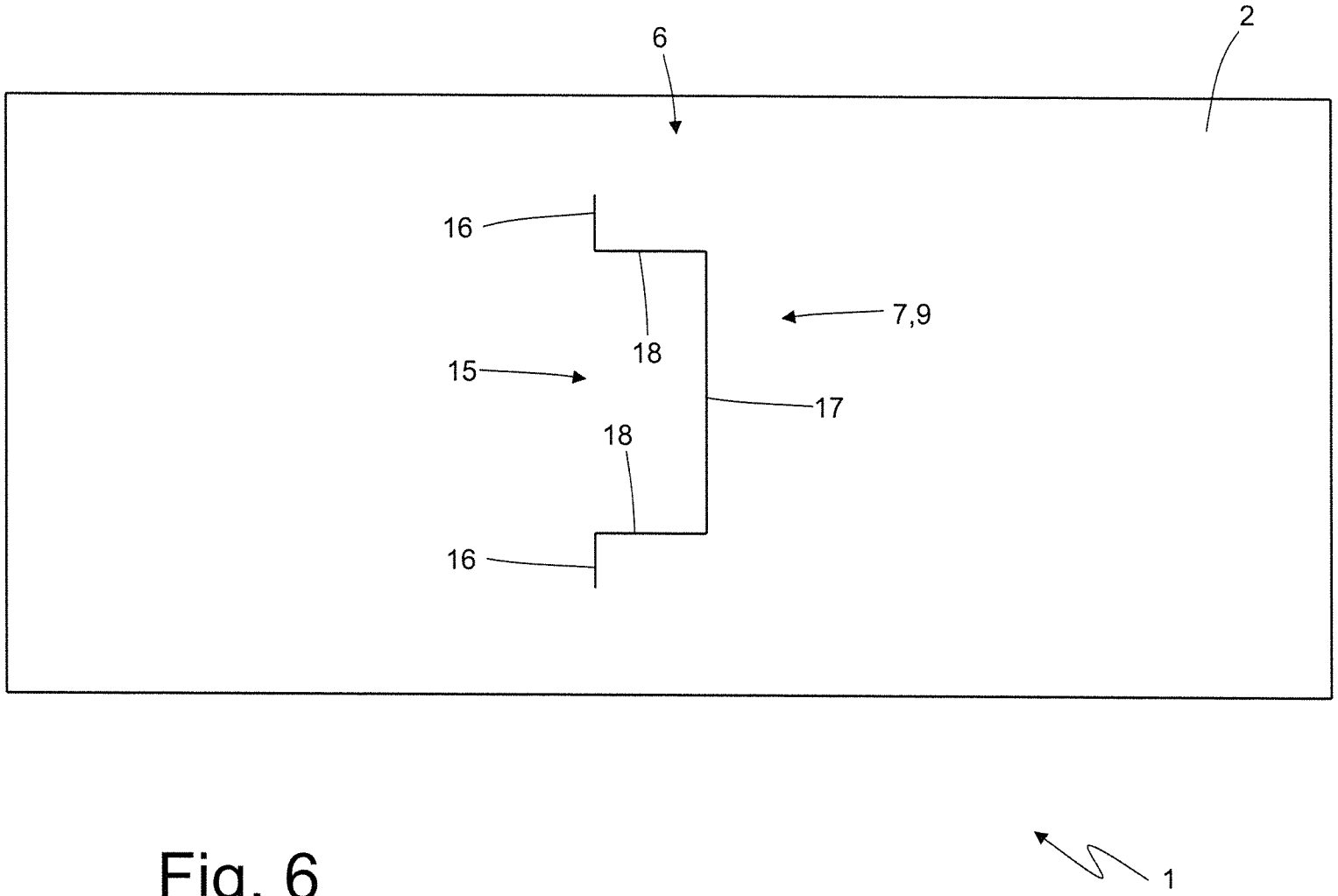
FIGS. 6-9 are bottom-up views of variations of FIG. 1 package.
Figure 7:
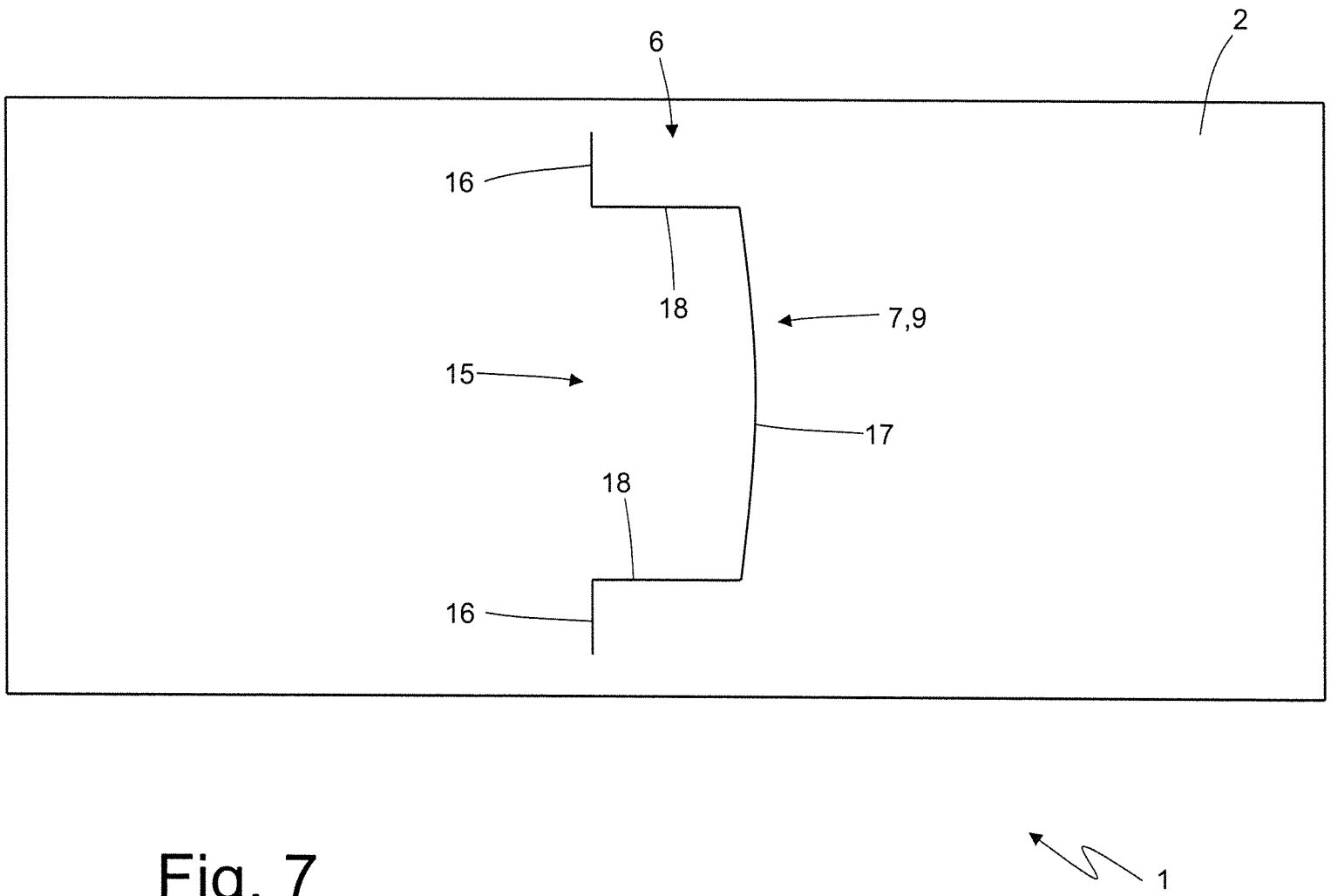
Figure 8:
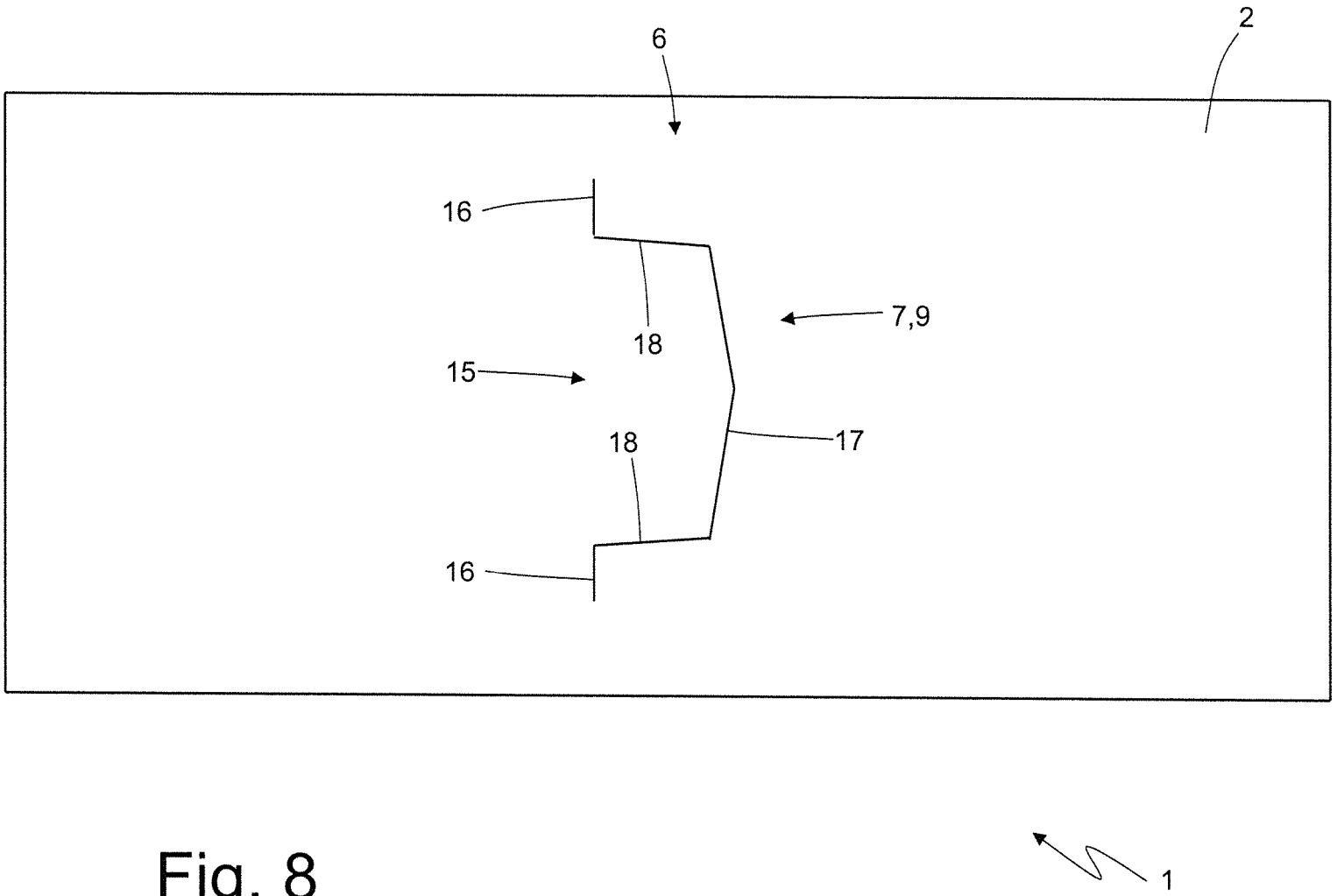
Figure 9:
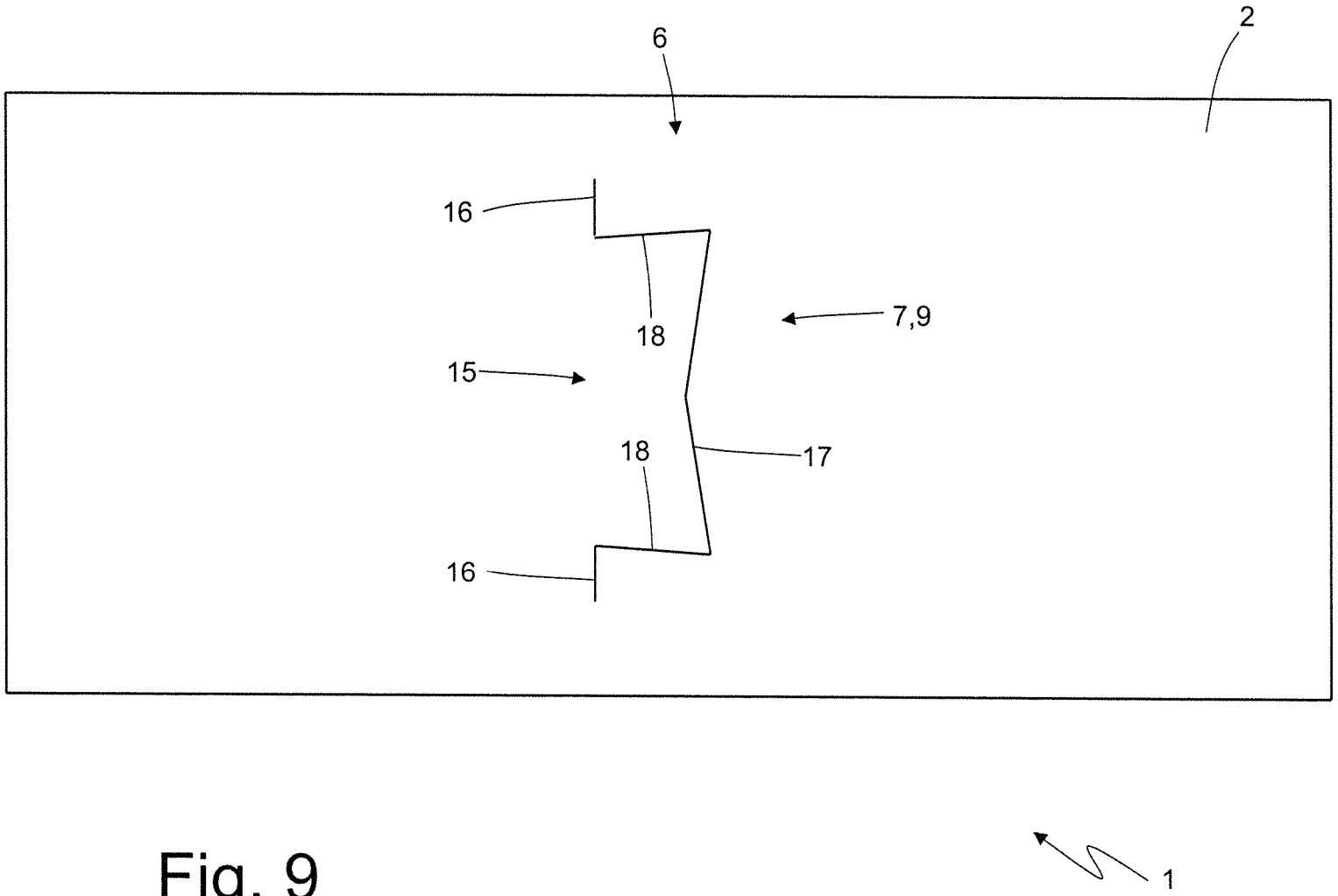

According to a possible embodiment, the weakened zone 6 (i.e. the two superposed incisions 7 and 9) increases as the density of the product 5 contained in the pocket 4 of the sealed single-dose package 1 increases, that is, the weakened zone 6 (i.e. the two superposed incisions 7 and 9) decreases as the density of the product 5 contained in the pocket 4 of the sealed single-dose package 1 decreases. As a result, the embodiment shown in FIG. 5 can be suitable to products with a higher density such as creams or granular products while the embodiment shown in FIG. 6 can be suitable to products with a lower density like liquids.

According to different embodiments shown in FIGS. 5-9, the main segment 17 can be linear, angled (broken) or curved. Likewise, also lateral parts 16 or joining segments 18 can be linear, angled (broken) or curved.

Figure 10:
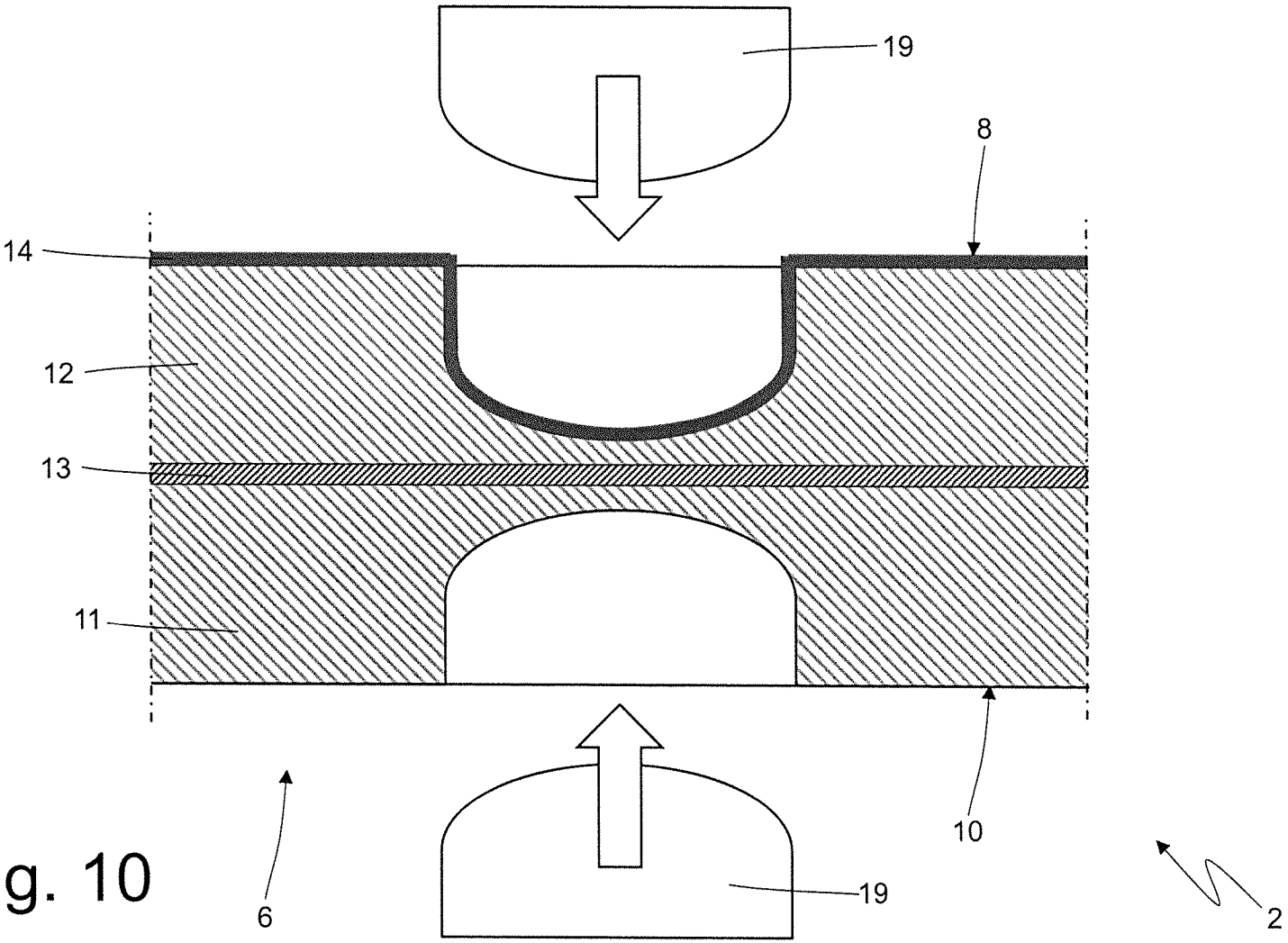
FIG. 10 is a schematic view in cross-section that illustrates the creation of a weakened zone of a semi-rigid sheet of FIG. 1 sealed package.

According to a possible embodiment shown in FIG. 10, the incisions 7 and 9 are made by means of plastic deformation of the material using corresponding incision tools 19, each of them having a tip that is not sharp, that is to say, that has a round shape (namely a rounded tip) for deforming rather than cutting the supporting layers 11 and 12 of the sheet 2 of semi-rigid plastic material.

According to the example of embodiment illustrated in the attached figures, the sealed single-dose package 1 has a rectangular shape; obviously due to aesthetic reasons the sealed single-dose package 1 may be shaped differently: rounded, elliptic, "bottle"-shaped, rhomboidal, pentagonal, hexagonal, triangular, squared, "bone"-shaped.

The sealed single-dose package 1 described above has numerous advantages.

Firstly, the sealed single-dose package 1 described above is easier and cheaper to produce than a similar known package 1 (for example of the type described in patent application WO2008038074A2), since the incisions 7 and 9 have a constant depth and therefore are easier to be made even with high operating speed.

Moreover, the package 1 described above allows to dose in a simple and efficient way all kind of fluid (liquid or creamy), powdered or granular products and it is particularly suitable for spreading the product 5 on a surface thanks to the area of the sheet 2 of semi-rigid plastic material enclosed by the central part 15 of the incisions 7 ad 9 that can be separated (moved) from the rest of sheet 2 of semi-rigid plastic material becoming a spatula useful to spread the product 5 itself. In other words, the central portion on the main segment 17, between joining segments 18 is designed to extend when package 1 is V-bended, in a trajectory beyond the adjacent structures of the sheet 2 of semi-rigid plastic material to work as a scoop for spreading the product that comes out from the opening (as shown in FIG. 3).

LIST OR REFERENCE NUMBERS IN THE FIGURES

1 package
2 semi-rigid sheet
3 flexible sheet
4 pocket
5 product
6 weakened zone
7 inner incision
8 inner surface
9 outer incision
10 outer surface
11 supporting layer
12 supporting layer
13 barrier layer
14 heat-sealable layer
15 central part
16 lateral part
17 main segment
18 joining segment
19 incision tool

The invention claimed is:

1. A sealed single-dose break-open package, comprising:
a first sheet of semi-rigid plastic material;
a second sheet of flexible plastic material superposed on and sealed to the first sheet to form a sealed pocket that contains a dose of a product; and
a weakened zone that is made in a central zone of the first sheet for guiding, after bending of the sealed package, controlled breaking of the first sheet at the weakened zone in such a way as to form an outlet opening for the product through the first sheet;
wherein the weakened zone comprises an incision that is made in a surface of the first sheet and extends on the surface of the first sheet along a single line that is open and does not cross itself;
wherein the single line comprises a "U"-shaped central part and two lateral parts that are positioned on opposite sides of the central part and connected to the central part.

2. The sealed single-dose break-open package according to claim 1, wherein the single line has an "Ω" shape.

3. The sealed single-dose break-open package according to claim 1, wherein the two lateral parts are constituted of two respective straight line segments that are identical in size and are aligned with each other.

4. The sealed single-dose break-open package according to claim 1, wherein the central part is constituted of a main segment that is parallel to and offset from the two lateral parts and of two joining segments that are parallel to each other and offset and each of which respectively connects one of the two lateral parts to one end of the main segment.

5. The sealed single-dose break-open package according to claim 4, wherein the two joining segments are perpendicular to the main segment and are perpendicular to the two lateral parts.

6. The sealed single-dose break-open package according to claim 1, wherein an overall size of the incision increases with an increase in density of the product.

7. The sealed single-dose break-open package according to claim 1, wherein the incision comprises:

an inner incision that is made in an inner surface of the first sheet facing the pocket; and an outer incision that is made in an outer surface of the first sheet opposite to the pocket and is identical to and aligned with the inner incision.

8. The sealed single-dose break-open package according to claim 1, wherein the incision has a constant depth along its length.

9. The sealed single-dose break-open package according to claim 1, wherein the first sheet a laminate and comprises:

a first supporting layer positioned externally on a side opposite to the pocket;

a second supporting layer positioned internally on a pocket side; and a barrier layer that is positioned between the first and second supporting layers.

10. The sealed single-dose break-open package according to claim 9, wherein the first sheet comprises a heat-sealable layer that is positioned in contact with the second supporting layer on the pocket side.

11. The sealed single-dose break-open package according to claim 9, wherein the incision comprises:

an inner incision that is made in an inner surface of the first sheet facing the pocket, affects the second supporting layer, and ends before the barrier layer; and an outer incision that is made in an outer surface of the first sheet opposite to the pocket, and is identical to and aligned with the inner incision, affects the first supporting layer, and ends before the barrier layer.

12. The sealed single-dose break-open package according to claim 1, wherein:

the sheet of semi-rigid plastic material comprises at least one supporting layer made of polystyrene; and the incision has a width of between 0.5 and 1.5 mm at the surface.

13. The sealed single-dose break-open package according to claim 1, wherein:

the first sheet comprises at least one supporting layer made of biaxially oriented polylactic acid or of polypropylene; and the incision has a width of between 2 and 4 mm at the surface.

14. A sealed single-dose break-open package, comprising:

a first sheet of semi-rigid plastic material;

a second sheet of flexible plastic material superposed on and sealed to the first sheet to form a sealed pocket that contains a dose of a product; and a weakened zone that is made in a central zone of the first sheet for guiding, after bending of the sealed package, controlled breaking of the first sheet at the weakened zone in such a way as to form an outlet opening for the product through the first sheet;

wherein the weakened zone comprises an incision that is made in a surface of the first sheet; and wherein the first sheet is a laminate and comprises:

a first supporting layer externally placed on a side opposite to the pocket;

a second supporting layer internally placed on a pocket side; and a barrier layer positioned between the supporting layers;

wherein the incision extends on the surface of the first sheet along a single zig-zag line which comprises a central part and two lateral parts that are positioned on opposite sides of the central part and connect to the central part, wherein the central part is constituted by a main broken segment and two joining segments, each of two joining segments respectively connecting one of the two lateral parts to one end of the main segment.

15. The sealed single-dose break-open package according to claim 14, wherein the first sheet comprises a heat-sealable layer positioned in contact with the second supporting layer on the pocket side.

16. The sealed single-dose break-open package according to claim 14, wherein the incision comprises:

an inner incision that is made in an inner surface of the first sheet facing the pocket, affects the second supporting layer, and ends before the barrier layer; and an outer incision that is made in an outer surface of the first sheet on the side opposite to the pocket, is identical to and aligned with the inner incision, affects the first supporting layer, and ends before the barrier layer.

17. The sealed single-dose break-open package according to claim 14, wherein:

the first and second supporting layers are made of polystyrene; and the incision has a width of between 0.5 and 1.5 mm at the surface.

18. The sealed single-dose break-open package according to claim 14, wherein:

the first and second supporting layers are made of biaxially oriented polylactic acid or of polypropylene; and the incision has a width of between 2 and 4 mm at the surface.

* * * * *